US009257110B1

(12) United States Patent
Smith

(10) Patent No.: US 9,257,110 B1
(45) Date of Patent: Feb. 9, 2016

(54) TORQUE SUPPRESSOR

(71) Applicant: Gordon S. Smith, Warren, NJ (US)

(72) Inventor: Gordon S. Smith, Warren, NJ (US)

( * ) Notice: Subject to any disclaimer, the term of this patent is extended or adjusted under 35 U.S.C. 154(b) by 302 days.

(21) Appl. No.: 13/802,736

(22) Filed: Mar. 14, 2013

Related U.S. Application Data

(60) Provisional application No. 61/618,786, filed on Apr. 1, 2012.

(51) Int. Cl.
*G10G 5/00* (2006.01)

(52) U.S. Cl.
CPC ..... *G10G 5/005* (2013.01)

(58) Field of Classification Search
CPC ..... G10G 5/005; G10G 5/00; G10G 7/00; G10G 7/005; G10G 7/02; Y10T 24/4736; Y10T 24/4745; A45F 3/14
USPC ..... 84/267, 327, 329
See application file for complete search history.

(56) References Cited

U.S. PATENT DOCUMENTS

| | | | | |
|---|---|---|---|---|
| 5,483,860 | A | 1/1996 | Adams | |
| 5,596,158 | A * | 1/1997 | Tonon | 84/327 |
| 5,936,173 | A | 8/1999 | Tonon | |
| 6,040,509 | A * | 3/2000 | Fanella | 84/280 |

* cited by examiner

*Primary Examiner* — Kimberly Lockett

(57) ABSTRACT

Disclosed is a torque suppressor for bodies having a forward assembly comprising an extension having a rear-portion, a mid-portion, and a fore-portion, wherein the fore-portion is configured to attach to the forward assembly, the rear-portion is configured to attach to the body at a forward point of attachment, and the mid-portion is configured to attach to a first end of a shoulder strap, the shoulder strap having a second end configured to attach to a rear point of attachment of the body. The device is effective in eliminating neck dive.

20 Claims, 12 Drawing Sheets

$$a = \mathrm{TAN}^{-1}\left(\frac{s}{h}\right)$$

$F_{nd} = W*SIN(0) = 0$

TOP
SIDE
100
100
4
4
22'
105
105
105'
120
120
110
110
110
110
130
130
150
150
115'
1
7
15

TORQUE SUPPRESSOR

CROSS-REFERENCE TO RELATED APPLICATIONS

This patent application claims priority to U.S. provisional patent application No. 61/618,786, filed 1 Apr. 2012, the disclosures of which are incorporated by reference herein in their entirety.

BACKGROUND OF THE DISCLOSURE

1. Field of the Disclosure

This invention relates to devices used to carry elongate items in a secure, convenient, and comfortable way where such items are typically carried with the assistance of a shoulder strap, and where such elongate items are musical instruments, such as various types of guitars or guitar-like instruments, keyboards, and the like.

2. Description of the Related Art

Acoustic guitars, electric guitars and other, guitar-like instruments such as the electric bass are typically played with both hands, and each hand plays a specific role in the production of musical sounds. Ideally, both hands should be totally unencumbered while playing such an instrument. As a result, simultaneously holding and playing the instrument may be problematic, especially while the player is standing. The ideal solution would ensure that the instrument is held in a secure, convenient and comfortable way with absolutely no effort or thought needed on the part of the player; furthermore, the instrument should be suspended in a position that each player would consider to be the ideal position for the instrument according to their own preference.

To answer this need in part, such instruments are often played with the use of a shoulder strap. The shoulder strap normally attaches to the instrument at two points: approximately where the neck of the guitar joins the body and at the rear of the body. In both cases, the preferred points at which the shoulder strap attaches to the instrument are typically on the ribs of the instrument body, "ribs" being a term of art for the "sides" of the body. A strap button is screwed into the ribs at each of these two locations, "strap button" being a term of art for a small cylinder (generally slightly less than a half inch in height and in diameter, and generally made out of metal) with a notch cut in the middle of its curved surface. A small hole in each end of the shoulder strap is affixed to each of the strap buttons by fitting the inner rim of each hole into the strap button notch. The shoulder strap is intended to stay in place as a result of friction and the location and depth of the strap button notch. For instruments set up for right-handed players, the side of the shoulder strap is typically worn over the left shoulder and the strap passes diagonally down the player's back, is routed under the player's right arm, and attaches to the strap button at the rear of the instrument body. For instruments set up for left-handed players, the orientation of the shoulder strap is reversed accordingly.

One problem associated with the use of the strap button is that the shoulder strap may slip off of one or both of the strap buttons due to variations in factors such as shoulder strap design or manufacture, strap button design or manufacture, strap button location, the manner in which the instrument is held, the weight of the instrument, the weight distribution of various parts of the instrument, and/or shoulder strap adjustments made for the player's comfort or convenience. Devices called strap locks are intended to be used in place of, or in conjunction with, strap buttons, and are designed to prevent such unintended disconnects.

The use of the shoulder strap and strap locks have to a great extent addressed the need to hold a guitar-like musical instrument or other similarly shaped item in a secure and convenient way. However, an instrument held in this manner may still demonstrate an uncomfortable weight distribution that makes the instrument pitch and/or yaw. A typical form of this problem is known as neck dive, a term of art used to describe the situation where the neck of the instrument is prone to pitch downward with enough force that the player must consciously support the neck while playing the instrument. Over the course of weeks or months, needing to support the neck in this manner is uncomfortable, tends to interfere with proper playing technique, and may lead to strain-related medical conditions. Neck dive is commonly reported to be a common attribute of electric bass guitars due to their weight and weight distribution in comparison to acoustic and electric guitars.

The problem of muscle strain resulting from neck dive is particularly acute when playing the low positions, that is to say positions of the fingering hand on the fingerboard closest to the headstock where the players fingering arm is most extended and has the least leverage.

Finger pressure, resulting from the tendency of the headstock to yaw away from the player may or may not be a problem, depending on the player. Some players like the extra pressure on the fingers as an aid to firmly pressing the strings down. Others dislike the interference with techniques demanding a light touch. The apparatus of the disclosure is adaptable to either taste as will be made apparent below.

A basic operating principle of this device is to provide a rigid, relatively lightweight and adjustable device that allows the portion of the shoulder strap that passes over the player's shoulder to be attached to the instrument at a different range of locations than would be possible without the use of the apparatus of the present disclosure. The shoulder strap locations that the torque suppressor makes available to the player will allow the instrument to be worn in a comfortable position that completely solves the problems of neck dive and neck yaw, as well as addressing the other issues discussed herein.

Three-point support has been used in the past, though without the use of a rigid extension. In such a setup, a shoulder strap is generally provided that extends from the back of the guitar to the headstock, or at least high up the neck. A second strap then connects to the front of the body of the guitar to the shoulder strap, usually with a slideable metal ring. The user adjusts the length of this second strap to neutralize neck dive. Such a rig can be seen in Tonon, U.S. Pat. No. 5,936,173, issued 10 Aug. 1999, for a "Suspension of Musical Instruments," (see FIG. 3). The problem with those systems, in lacking the rigid extensions of the present disclosure, is that neck dive is only neutralized at a single fixed position. As soon as the player lifts the headstock, the shoulder strap goes slack and the configuration causes the instrument body to fall down and away to the back, accompanied by neck dive. Pushing the headstock downward causes the shoulder strap to tighten and the instrument body to be pulled upward and forward, accompanied by neck lift. All of which is to say that the instrument always pushes back toward its original set position. This is fine for those who don't move their guitar around during a performance and play simple chords, but the benefits of these kinds of flexible three point suspension are minimized or lost completely when the performer moves the neck of the instrument up or down to any substantial degree. All but the most rigorously trained and disciplined performers will demonstrate some such movement. Further, the second strap obstructs "over-the-board" playing wherein the performer reaches over the fingerboard rather than under it. The so called "two-handed tapping" technique, for example, involves bringing the right arm over the fingerboard and the left hand under it (for right-handed players).

BRIEF DESCRIPTION OF THE DISCLOSURE

Disclosed is a torque suppressor for bodies having a forward assembly comprising an extension having a rear-portion, a mid-portion, and a fore-portion, wherein the fore-portion is configured to attach to the forward assembly, the rear-portion is configured to attach to the body at a forward point of attachment, and the mid-portion is configured to attach to a first end of a shoulder strap, the shoulder strap having a second end configured to attach to a rear point of attachment of the body.

The torque suppressor is conveniently attached to most electric guitars and basses, as well as other guitar-like instruments and other items that would ordinarily be held using a shoulder strap in the manner of a guitar. The disclosure is of an optionally contoured extension that is attached to the instrument at two points: one end to the body of the instrument, the other to the headstock or neck. The shoulder strap then connects from the back of the instrument to the extension, providing three-point support. The disclosed device exhibits total or near total neutralization of neck dive regardless of the position of the instrument and presents no obstruction to "over-the-board" playing, such as two-handed tapping.

DETAILED DESCRIPTION OF PREFERRED EMBODIMENTS

Figure 1:
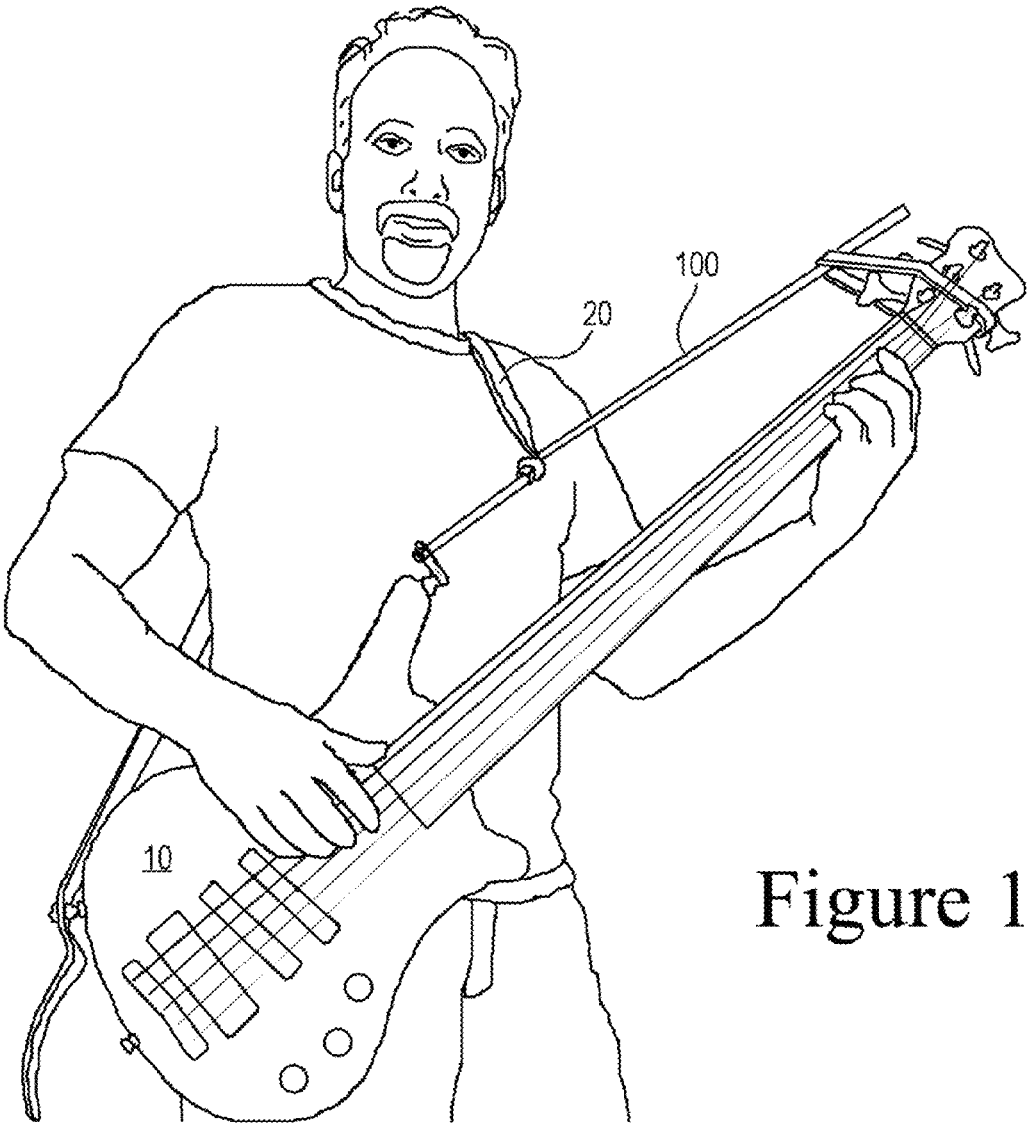
FIG. 1 is a perspective view of an embodiment of a torque suppressor of the disclosure in actual use by a right-handed player of an instrument.

Referring to FIG. 1, there is shown an instrument 10 supported by an embodiment of the torque suppressor 100 of the disclosure in combination with a shoulder strap 20.

Figure 2:
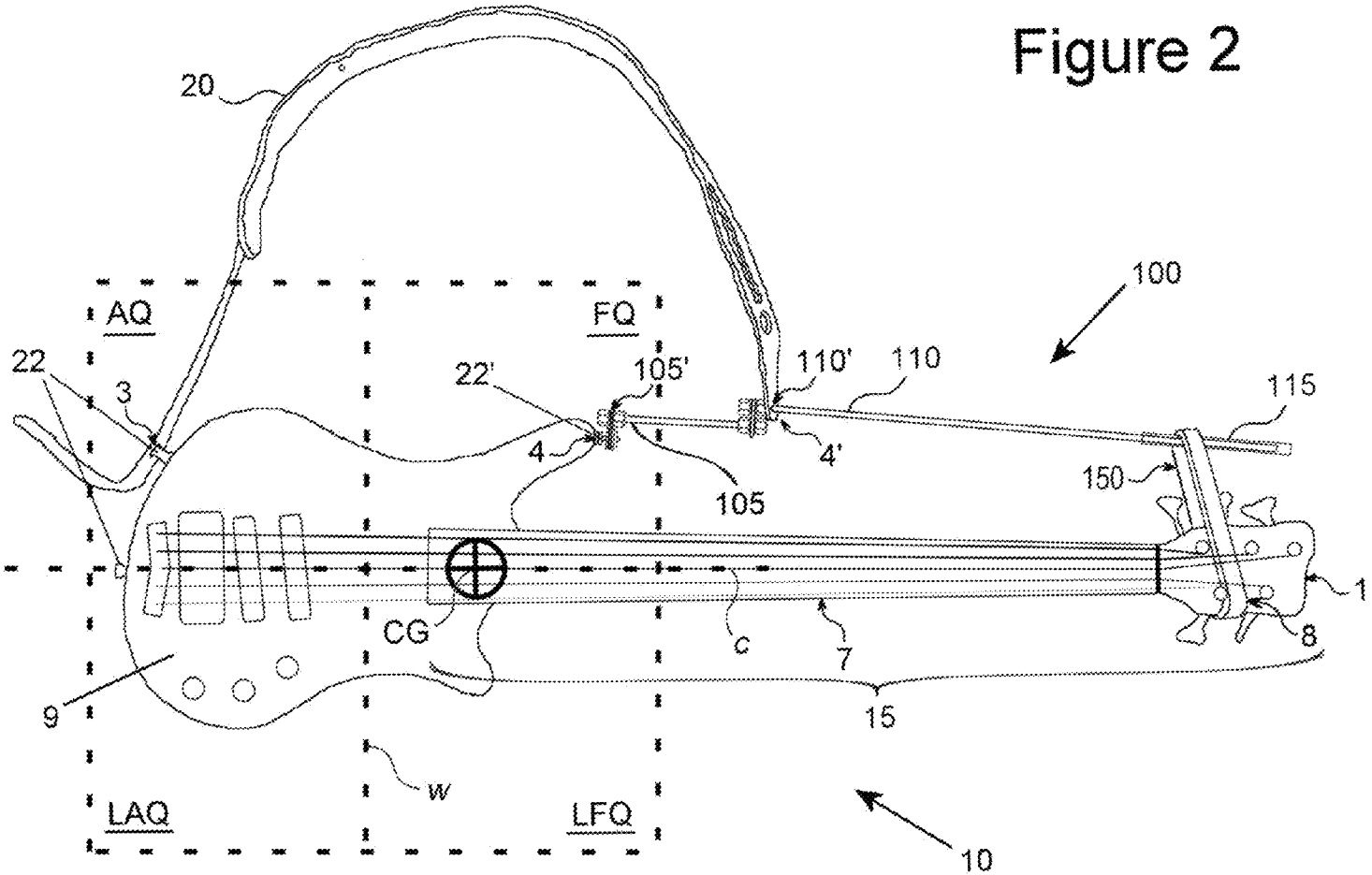
FIG. 2 is a side view of an embodiment of a torque suppressor of the disclosure mounted to an electric guitar in conjunction with a shoulder strap.

Referring to FIG. 2, there is shown a more detailed view of the instrument 10 of FIG. 1, an electric guitar, wherein the guitar comprises a body 9 in attachment to a forward assembly 15, said forward assembly 15 comprising a neck 7 and a headstock 1. The instrument 10 has a center of gravity CG (i.e., center of mass), that is separate and apart from the mass contributions of the torque suppressor 100 and shoulder strap 20. One may define the forward assembly 15 in most circumstances as that major portion of an instrument whose contribution to the position of the center of gravity CG is derived more from the distance from the center of gravity CG than the weight of its infinitesimal mass components.

The body 9 of the instrument 10 may also be referred to as an "aft assembly" in cases where the instrument has a rearward portion that is difficult to visually distinguish from the forward assembly 15, such as is the case with a keyboard. The body 9 or "main assembly" would be considered that portion of the instrument 10 that normally sets in front of the player's torso. One may define an imaginary centerline c that runs along the length of the instrument aft to fore and an imaginary waistline w that runs across the body 9 at a geometrically suitable point so as to define four quadrants, namely a forequadrant FQ, an aftquadrant AQ, a lower forequadrant LFQ, and a lower aftquadrant LAQ. The configuration shown is for a right-handed player. Note then, that should the instrument shown be picked up by a left-handed player, the instrument is rotated 180° such that what is now the lower forequadrant LFQ and lower aftquadrant LAQ become the new forequadrant FQ and aftquadrant AQ, respectively, and vice-versa.

In the aftquadrant AQ of the instrument 10 are at least one strap mounts 22, 22' such as, for example, strap buttons 22, to receive one end of the shoulder strap 20 and another in the forequadrant, such as, for example, a strap lock 22' (or they can all be strap buttons or strap locks or any other device effective in mounting the shoulder strap). In this way, the traditional strap configuration comprises a rear point of attachment 3 and a forward point of attachment 4, both on the body 9.

The torque suppressor 100 of the disclosure comprises a rear-portion 105 a mid-portion 110, and a fore-portion 115 that together provide a rigid extension projecting outward from the body 9 generally in the direction of the forward assembly 15 and generally parallel thereto. The rear-, mid-, and fore-portions may be in the nature of rod-like elements made of metal, polymer, carbon fiber, and composites thereof and the like, and may optionally be coated with a protective polymer coating. The rear-portion 105 is provided a body attachment device 105' that connects to and supports a location within the forequadrant FQ of the instrument body 9. The fore-portion 115 is provided a fore-portion attachment assembly 150 (in this drawing, a strap) that connects to and supports the foreword assembly 15 of the instrument, namely at the headstock 1 or neck 7 when the instrument 10 is a guitar or other neck-and-stock instrument. Preferred materials for the fore-portion attachment assembly 150 are those without resonant characteristics, that is to say it is preferably designed to dampen and isolate vibrations between the instrument and the torque suppressor 100.

The mid-portion 110 is provided with a strap attachment device 110' that receives an end of the shoulder strap 20, thereby defining a new adjusted point of attachment 4' for the strap 20. In the example shown, the strap attachment device 110' is simply an aperture in the strap 20 slipped over the mid-portion 110.

The forward attachment device 105' may be jointed so as to permit hinging or swivel motion of the torque suppressor with respect to the body 9 and thereby avoid undue stresses at the forward point of attachment 4. Suitable forward attachment device 105' may include a strip of a durable flexible material such as leather, strong polymer textile and the like, or a hinge arrangement, ball joint, or universal joint and the like. Preferred materials are those without resonant characteristics, that is to say the forward attachment device is preferably designed to dampen and isolate vibrations between the instrument and the torque suppressor 100.

Note that there is often no clear boundary between the mid-portion 110 and the fore-portion 115, and the two may be said to often overlap, or transition into one another. This is also true of the mid-portion 110 and the rear-portion 105 as will be described in more detail below with respect to FIG. 7.

As can be seen, the introduction of the torque suppressor 100 results in an overall configuration wherein the instrument 10 is supported at three points of attachment 3, 4', 150, while the shoulder strap's 20 traditional function of connecting at only two points of attachment 3, 4' remains unchanged except insofar as the foreword point of attachment 4 for the strap 20 is now transferred from the body 9 to the torque suppressor 100 at the adjusted forward point of attachment 4'.

Note also that the center of gravity CG of the instrument is about laterally centered between the strap attachment points 3, 4' when the torque suppressor is installed. Without use of the torque suppressor 100, the center of gravity is laterally positioned substantially closer to the rear point of attachment 3 than the forward point of attachment 4.

Figure 3:
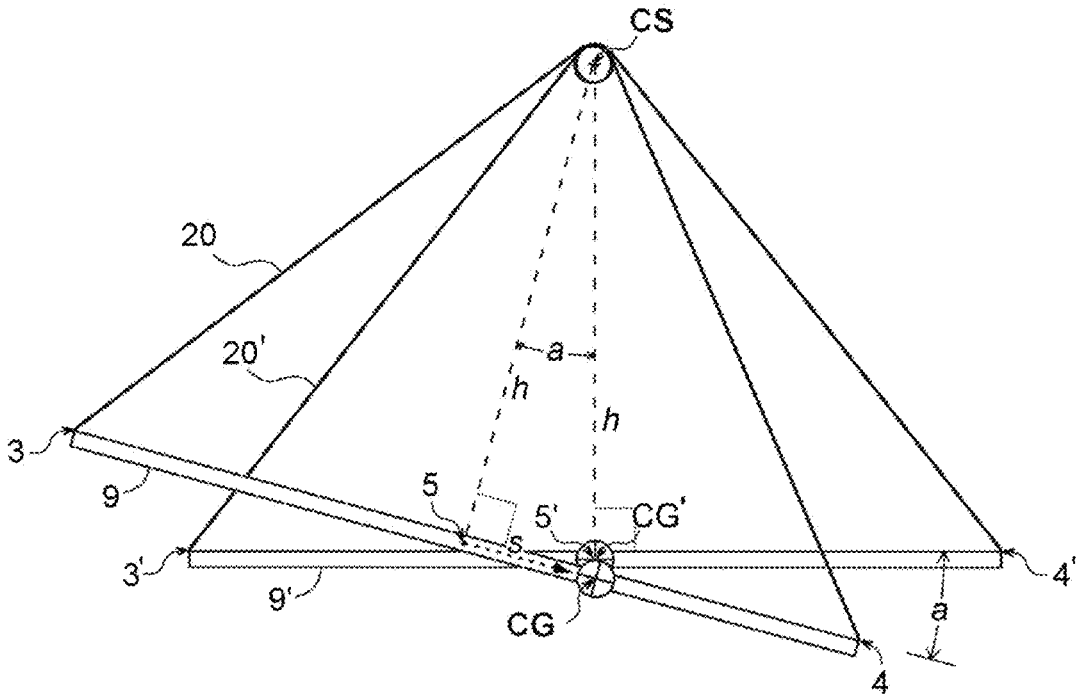
FIG. 3 is a schematic representation of some basic mechanics of neck dive.

Referring to FIG. 3, the effect of the relative positioning of the center of gravity CG with respect to the strap attachments may be graphically simplified. Here, an ideal balanced body 9' having a center of gravity CG is suspended from and about a pivot, or center of support CS, which would correspond to the neck and shoulder area of a player of the balanced body 9'. The center of gravity CG is located dead center of the balanced body 9', exactly equidistant from the points of attachment 3', 4' of the strap 20, at a location that will be referred to as the midpoint of support 5'. The length of the strap defines a height h of the center of support CS directly above the center of gravity CG' and midpoint of support 5'.

Superimposed upon the body is another body 9 suspended upon the identical center of support CS by an identical strap 20 connected at rear 3 and forward 4 points of attachment. The only difference here is that the density distribution is not identical to that of the balanced body 9', but rather is such that its center of gravity CG is shifted forward a distances from its midpoint of support 5.

In both cases, the equilibrium or stable configuration of a free swinging body is that the center of gravity, like a pendulum, will settle directly below the center of support CS, therefore, the body 9 pitches downward. Through some basic trigonometry it is easily found that the body 9 will pitch downward relative to the balanced body 9' to settle at a pitch angle a, which is equal to the arctangent of s/h. For small angles, a is linearly proportional to the displacement s.

Figure 4:
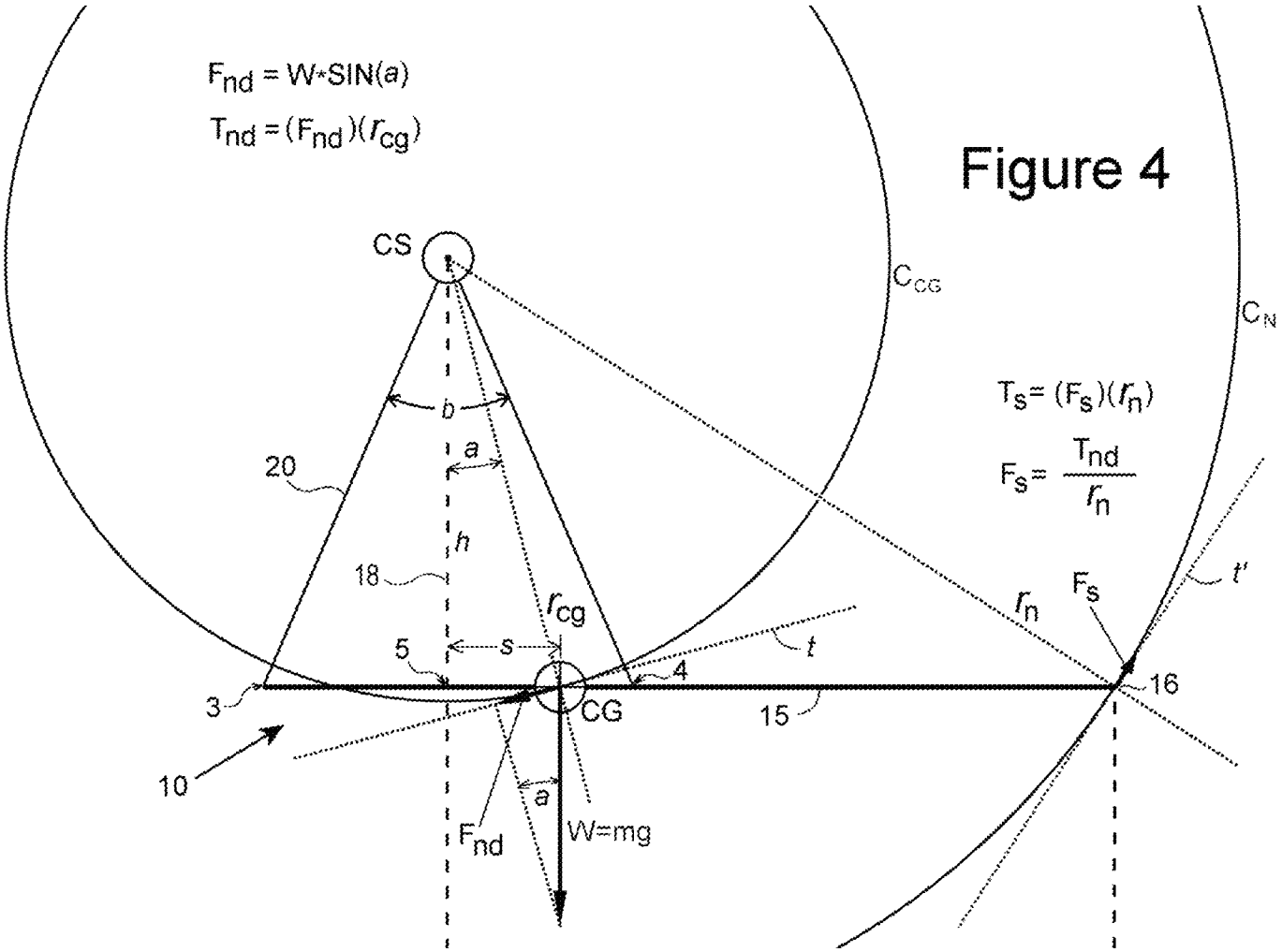
FIG. 4 is a detailed schematic representation of the physics of neck dive.

Referring now to FIG. 4, there is shown an idealized schematic of the forces acting upon an instrument 10 having a forward assembly 15, such as a guitar. Here is seen a center of gravity CG located forward of the midpoint of support 5 as defined by rear and forward attachment points 3, 4 for the shoulder strap 20. A forward assembly 15 extends out to a low position 16, which are the finger positions on the fingerboard closest to the headstock, so named for the low pitch notes generated at that region.

The center of gravity CG of the instrument 10 is displaced a distance s from the midpoint of support 5, said midpoint of support disposed a distance h directly below the center of support CS in this example, and located upon a bisector 18 that bisects an angle b formed by the strap 20. Note how the line corresponding to the distance h bisects the angle formed by the strap. The distance from the center of support CS to the center of gravity defines a radius of length $r_{cg}$ that in turn defines a center of gravity circle $C_{CG}$ with the center of support CS as its center.

As was shown in the description of FIG. 3, it can be seen that the instrument 10 will seek to pitch downward, or "neck dive," so as to position the center of gravity CG directly below the center of support CS, which is to say that the center of gravity in the configuration shown is exerting a clockwise neck dive torque $T_{nd}$ about the center of support CS.

To calculate the neck dive torque $T_{nd}$ we measure or calculate a displacement angle a as the arctangent of s/h. This angle may then be used to calculate the projection of the center of gravity's weight W vector upon a tangent to the circle $C_{CG}$. This projection is the force vector of the neck dive $F_{nd}$ that is then multiplied by the radius $r_{cg}$ to obtain the neck dive torque $T_{nd}$. Typical values for an electric bass guitar will be about 18" (1.5 ft.) for the radius and 4" (0.33 ft.) for the displacement of a center of gravity weighing 10 pounds, such as might be the case for a Warwick Pro Thumb BO fretless five-string electric bass guitar as was used as the model for FIGS. 1, 2, and 8 in the drawings. This yields a neck dive force $F_{nd}$ of about 4.3 lbs delivering a neck dive torque $T_{nd}$ of about 6.4 ft-lbs.

It is desirable to suppress the neck dive by counteracting the torque. At present, this is done manually by the player of the instrument. Consider the player extending his arm out to the low position 16 to play a chord, we see that the low position of the neck is a radius $r_n$ from the center of support CS defining a circle $C_N$. To achieve the objective, a force must be applied here that generates a suppressive force projection $F_S$ upon tangent t' such that a counter-clockwise suppressive torque $T_S$ is obtained that is substantially equal and opposite to the neck dive torque $T_{nd}$, or in the language of vectors: nd+s=0.

From all this, it can be seen that the equation for the tangential suppressive force $F_S$ is given by $F_S=T_{nd}/r_n$. A typical value for the distance from the center of support CS to the low position 16 (e.g., from the intersection of the player's neck and shoulder to the palm of his hand) is about 33" (2.75 ft.). Substituting the neck dive torque $T_{nd}$ value of 6.4 ft-lbs obtained above, we derive a suppressive force projection $F_S$ of about 2.3 lbs. One may appreciate the arm strain suffered by the guitar player over prolonged performance.

Figure 5:
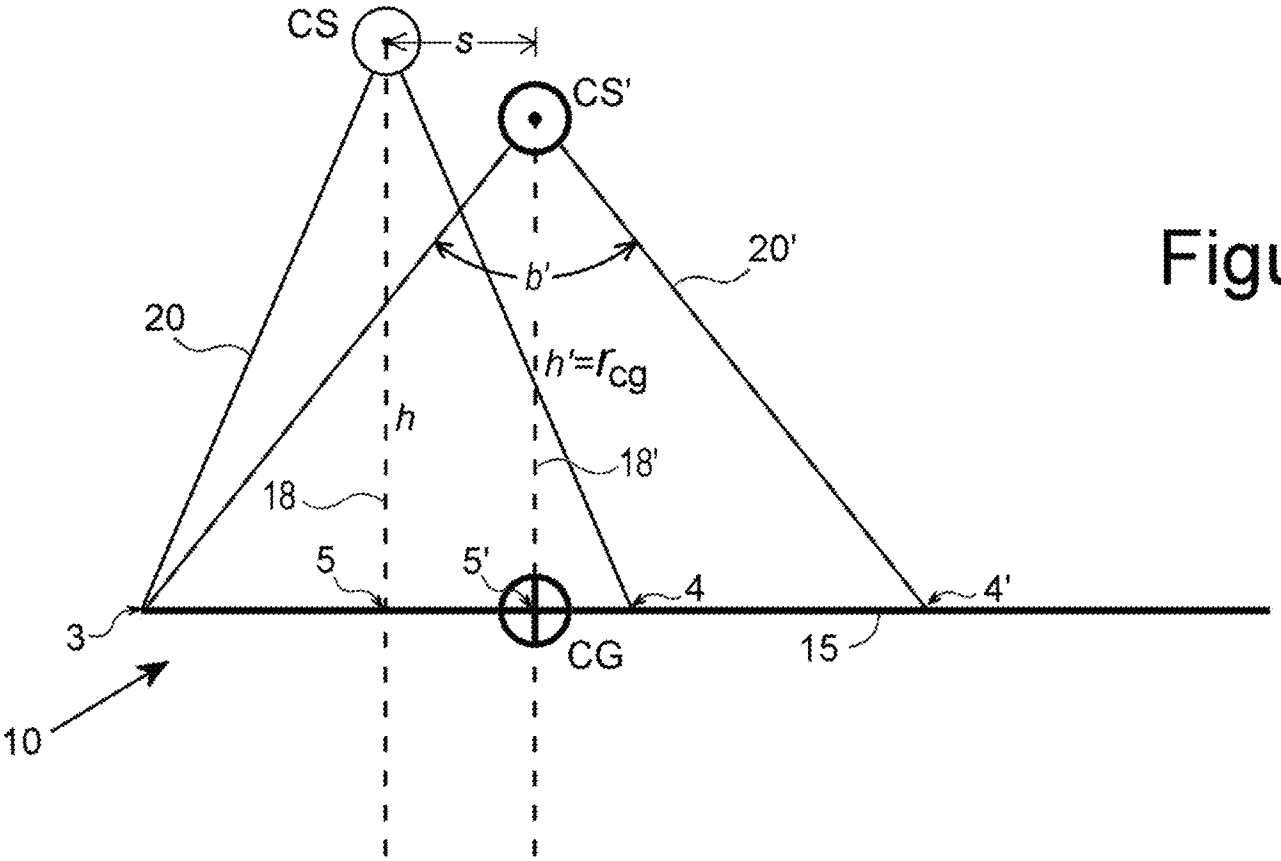
FIG. 5 is a schematic of a configuration of the invention.

Referring to FIG. 5, it is shown that the neck dive force $F_{nd}$ may be suppressed by relocating the forward point of attachment 4 to the adjusted point of attachment 4' so as to establish a new midpoint of support 5' that substantially coincides with the center of gravity CG. The result is that the center of gravity radius $r_{cg}$ now coincides with the new bisector 18', which reduces the pitch angle a (FIG. 4), and therefore the neck dive force $F_{nd}$, to zero.

Figures 6A, 6B:
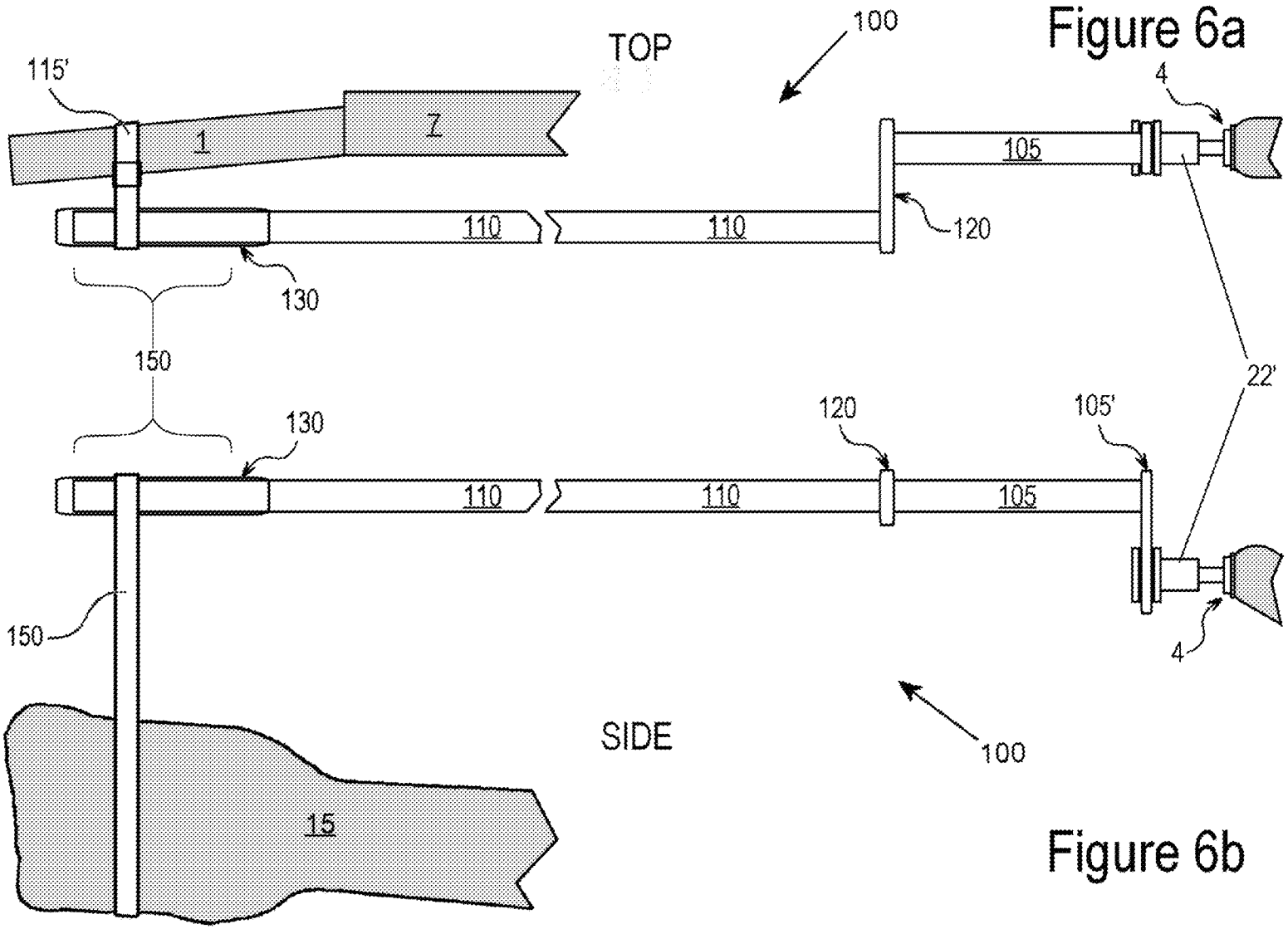
FIGS. 6*a* and 6*b* are top and side views of a torque suppressor of the disclosure.

Referring to FIGS. 6*a* and 6*b*, there are shown a side-by-side comparison of top and side views of an embodiment of the torque suppressor 100 of the disclosure as applied to a guitar. Note that the side view of FIG. 6*b* is, unlike that of FIG. 2, a perspective from the point of view of the right-handed player, or the perspective of one standing behind the player and looking through him. Likewise, FIG. 6*a* is a perspective of the player looking down at the device.

As can be seen, a transition portion 120 connects the rear-portion 105 to the mid-portion 110 so as to create an overall contour that brings the fore-portion 115 of the torque suppressor 100 within proximity to the headstock 1, which extends at an angle from the neck 7. The headstock 1 and neck 7 together comprise the forward assembly 15. The fore-portion 115 may be provided with a protective sleeve 130, such as a section of rubber or polymer tubing, to prevent damage to or from the fore-portion attachment assembly 150 and/or provide a non-slip surface to prevent the forward attachment device from sliding along the fore-portion 115.

Note, however, that in this embodiment, the fore-portion 115 is not disposed directly above the forward assembly 15, but rather slightly behind it. This positioning provides some pull, in that the fore-portion attachment assembly 150 pulls back on the forward assembly 15 and thereby counteracts the neck yaw as described above. As stated earlier, this is only an option because many instruments demonstrate no neck yaw and many players don't mind those that do.

Figure 7A:
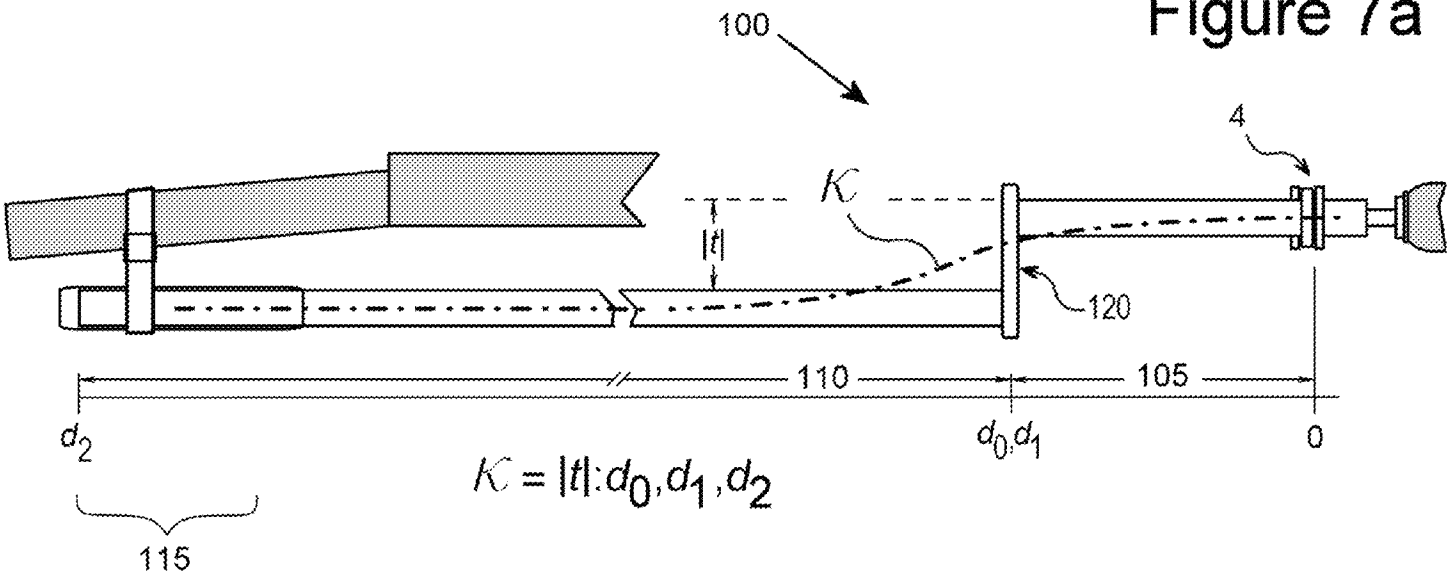
FIGS. 7*a* and 7*b* are top views of two embodiments of torque suppressor of the disclosure and their contours.
Figure 7B:
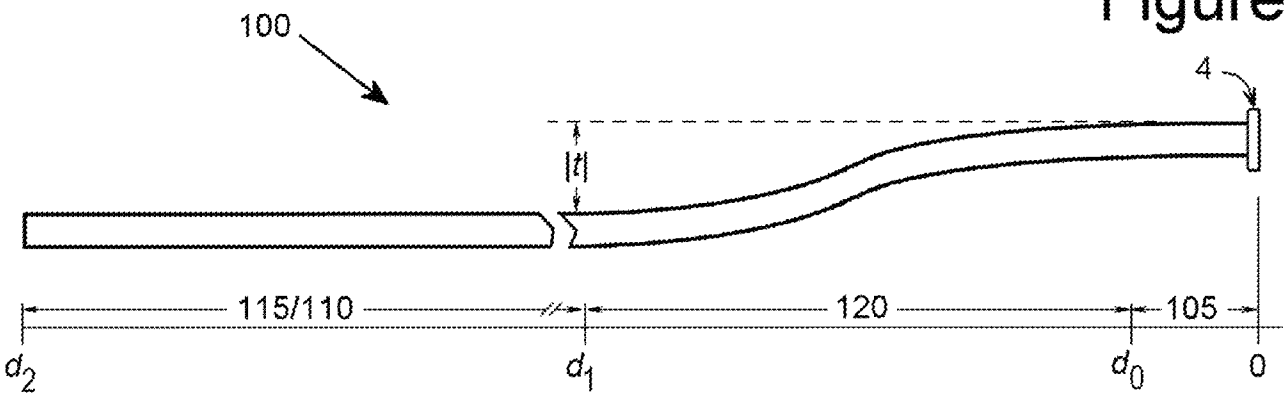

Referring to FIGS. 7*a* and 7*b*, There is shown the embodiment in FIG. 7*a* as described thus far and another embodiment in FIG. 7*b*. In FIG. 7*a*, the rear-portion 105 has been shown as a rod-like element, the transition-portion 120 as a plate-like element, and the mid-portion 110 and fore-portion 115 as a unified rod-like element. The overall configuration of the torque-suppressor 100 defines a contour κ that may be simplified and defined by three length parameters in the equality:

$$\kappa=|t|:d_0,d_1,d_2 \quad \text{(Eq. 1)}$$

where |t| is the lateral offset (usually toward the player) from the transition effected by the transition-portion 120 from the forward point of attachment 4 to the mid-portion 110, $d_0$ is the distance from the forward point of attachment 4 to the start of the transition-portion 120, $d_1$ is the distance from the forward point of attachment 4 to the finish of the transition-portion 120 (the start of the mid-portion), and $d_2$ is the total length of the torque-suppressor 100 from the forward point of attachment 4 to the distal end of the fore-portion 115. Note that in FIG. 7*a*, the transition-portion 120, which presents as a plate material, is so thin that for all practical purposes one may take $d_0=d_1$.

Referring now to FIG. 7*b*, in another embodiment the torque suppressor 100 is constructed of a single shaped bar comprising the rear-portion 105, transition-portion 120, mid-portion 110, and fore-portion 115 forged as a single unit. It can be seen that $d_0$ and $d_1$ are affected and gives some idea how the above equation for the contour κ provides information about the device. For example, if all the contour κ parameters equal zero, then one knows immediately that the device is a single straight rod.

Suggested contour κ parameter ranges (in inches) are |t|=0-2, $d_0$=0-6, $d_1$=0-12, and $d_2$ as long as required to reach the fore-portion attachment assembly 150.

Figure 8:
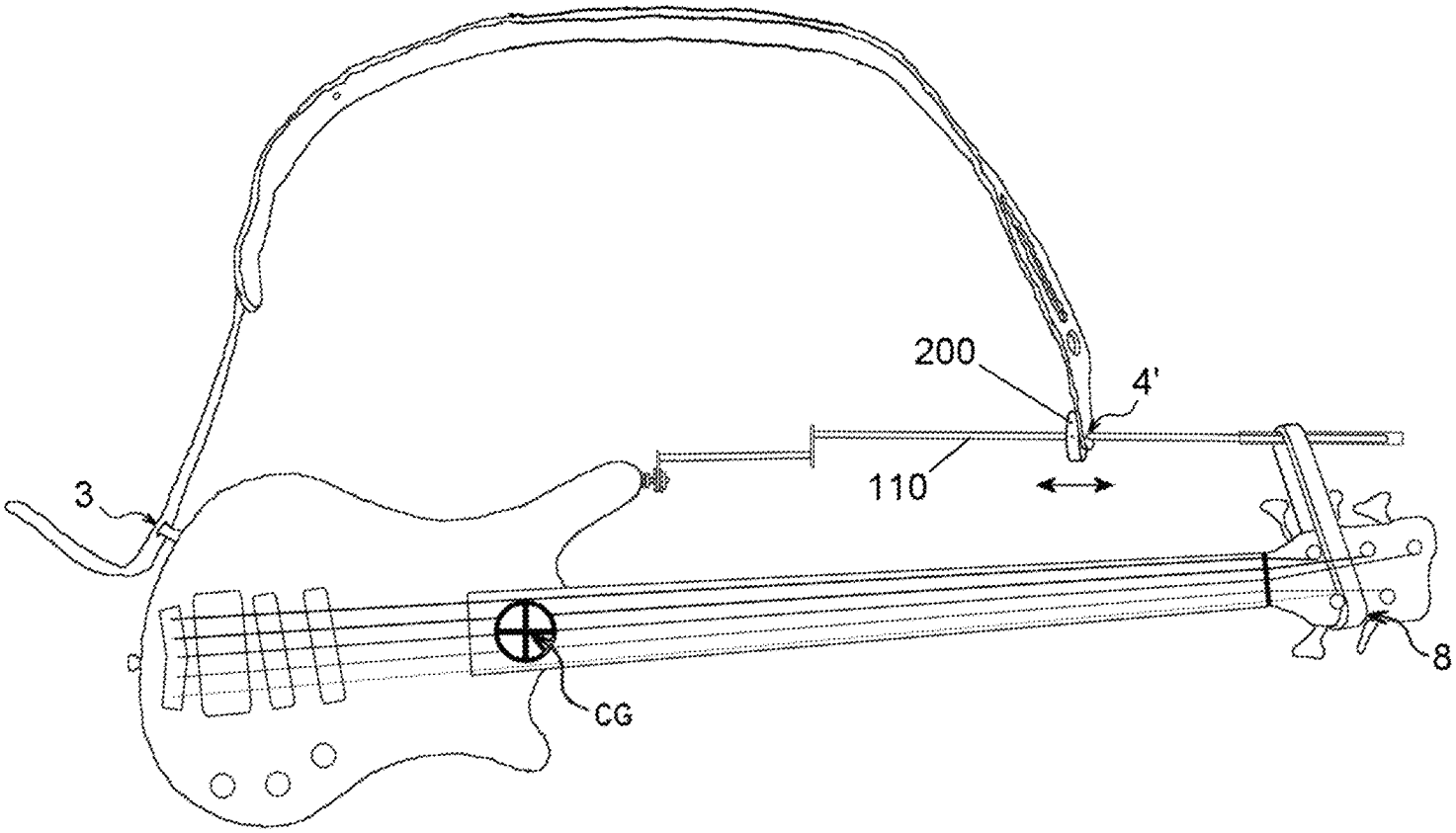
FIG. 8 is a perspective view of a shuttle.

Referring to FIG. 8, there is shown an option for the torque suppressor 100, namely a shuttle 200 that is moveably disposed on the mid-portion 110 of the torque suppressor 100, thereby comprising and defining the adjusted point of attachment 4'. By having the option of moving and setting the adjusted point of attachment 4' at will, the torque suppressor 100 may be used and fine-tuned to instruments of varying makes and models. The shuttle 200 may be fixed in position in any number of known ways, such as a friction fit, clamp set screw, or alternatively, the mid-portion 110 may be provided with a screw thread that fits a complimentary thread machined into the shuttle 200 (threads not shown) and the shuttle adjusted laterally by rotation, as a hex nut would. Indeed, with a closely conforming aperture at the end of the shoulder strap 20, a large enough hex nut would serve sufficiently as a shuttle 200, particularly if further equipped with a sizable washer (not shown).

Figure 9:
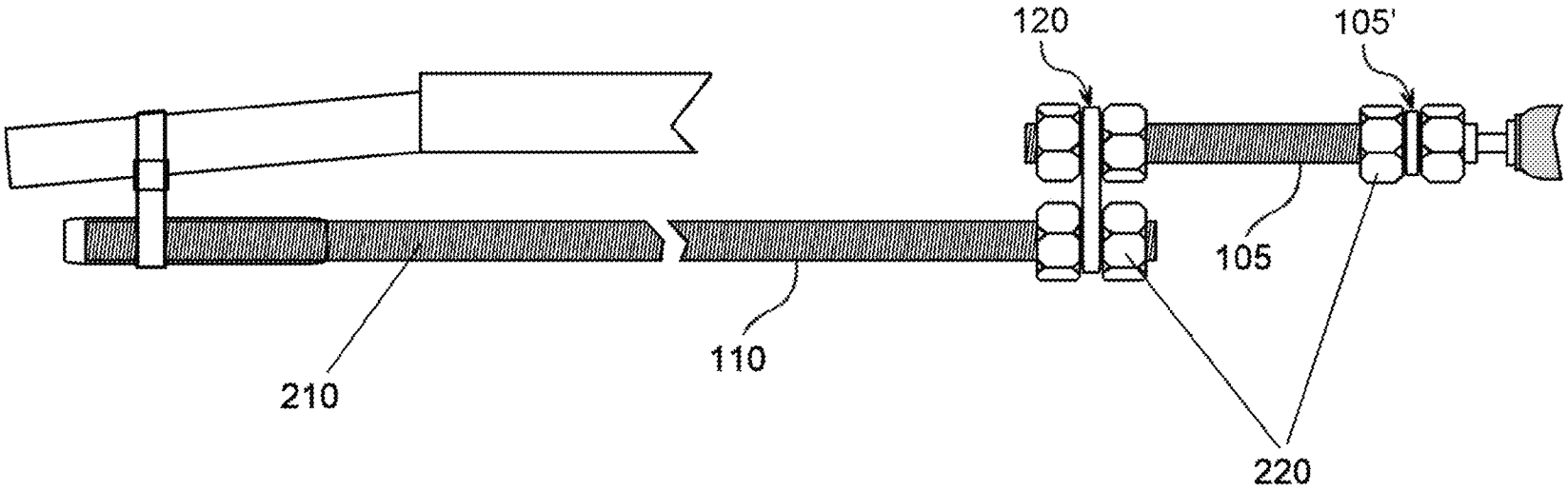
FIG. 9 is a DIY embodiment of a torque suppressor of the disclosure.

Referring now to FIG. 9, we see an embodiment of the torque suppressor that may be manufactured do-it-yourself (DIY) from parts readily available at most hardware stores. Threaded steel stock 210 is readily obtained to serve as the rear-portion 105 and mid-/fore-portions 110/115. Metal plate stock with a pair of holes drilled through will serve as a transition-portion 120 and used to clamp the end of the mid-portion to an end of the rear-portion 105 with a plurality of nuts 220. The remaining end of the rear-portion 105 is likewise clamped onto the body attachment device 105', which may be fashioned from a strong flexible material, such as a leather or polymer strip, also having holes drilled through.

Figure 10:
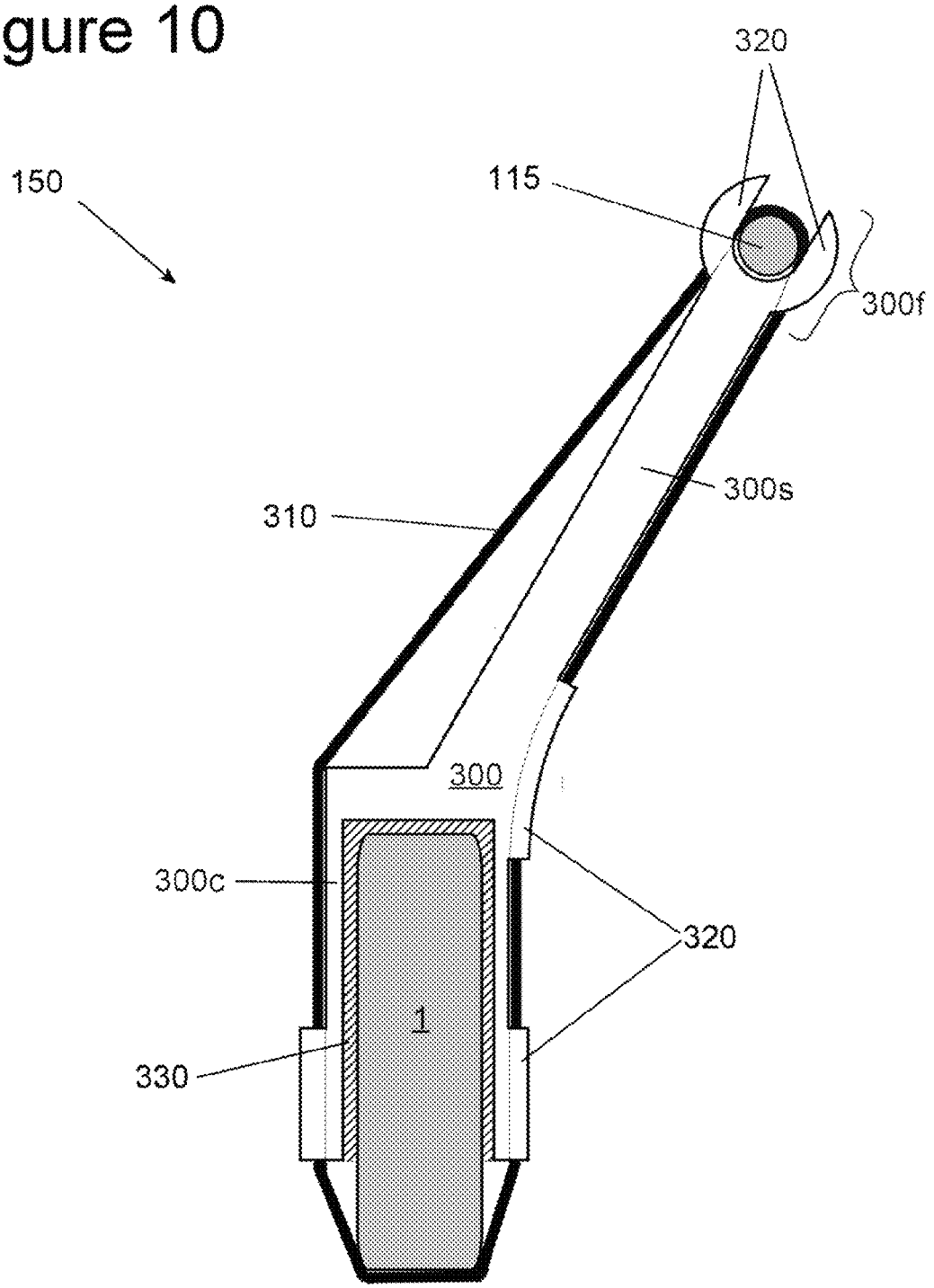
FIG. 10 is a side view of a spacer.

Referring to FIG. 10, there is shown another option for the torque suppressor 100 of the disclosure, namely a fore-portion attachment assembly 150 comprising spacer 300 for keeping the fore-portion 115 of the torque suppressor from approaching any further than a minimum distance from the forward assembly 15 so as to avoid a collision thereof. Such collision on fine instruments will likely cause at least scratching of finely finished surfaces, if not more substantial damage, particularly to the headstock 1 of a guitar, which possess a plurality of finely machined mechanics mounted upon them.

The spacer 300 comprises a rigid or semi-rigid spacing member 300*s* extending from a clip member 300*c*. The clip member is adapted to fit to an extended portion of the instrument 10 (FIG. 2), such as the headstock 1 of a guitar-like instrument. The spacer further comprises a fore-portion attachment portion 300*f* for attachment of the spacing member 300*s* to the fore-portion 115 of the torque suppressor. A spacer strap 310 is provided that snugly fits around the fore-portion, runs down opposing sides of the spacing member 300*s*, down opposing sides of the clip-member 300*c* and around the bottom of the headstock 1 or whatever other instrument component the spacer 300 is designed to attach to. The spacer strap 310 is restrained from slipping off its intended path by a plurality of strap guides 320.

Note that the spacing member 300*s* as shown is angled toward the player so as to adapt to the contour κ of the torque suppressor 100 (FIG. 2).

In the embodiment shown, the fore-portion attachment portion 300*f* may comprise strap guides 320 that double as a fork configuration to securely seat the fore-portion of the torque suppressor.

In many cases it may be desirable to provide a scratch-proof coating 330 interposed between the clip-member 300*c* and the instrument to avoid scratching the instrument surface. Materials such as velvets, plushy polymer and natural textiles may be used.

Useful "rubbery" or "skin-like materials may be used for the scratch-proof coating 330, such as simple natural or synthetic rubbers, silicon rubber, polychloroprene rubbers, and thermoplastic elastomers (TPE), such as ethylene propylene diene monomer (EPDM) rubbers, and the like. These rubbers may be blended with polymers as needed to obtain the desired physical characteristics. Preferred sheath materials are thermoplastic vulcanates (TPV) comprising finely divided rubber particles, either partially or fully cross-linked, which are commercially available and sold under the tradename SANTOPRENE® by Exxon Mobile Corp. Also usable are thermoplastic vulcanates (TPV) comprising finely divided rubber particles set in a thermoplastic matrix, such as those sold under the tradename VYRAM®, also by Exxon Mobile.

As always, it is preferred that materials selected for the fore-portion attachment assembly 150 comprise a material without resonant characteristics, that is to say that the unit is preferably designed to dampen and isolate vibrations between the instrument and the torque suppressor 100.

Figure 11:
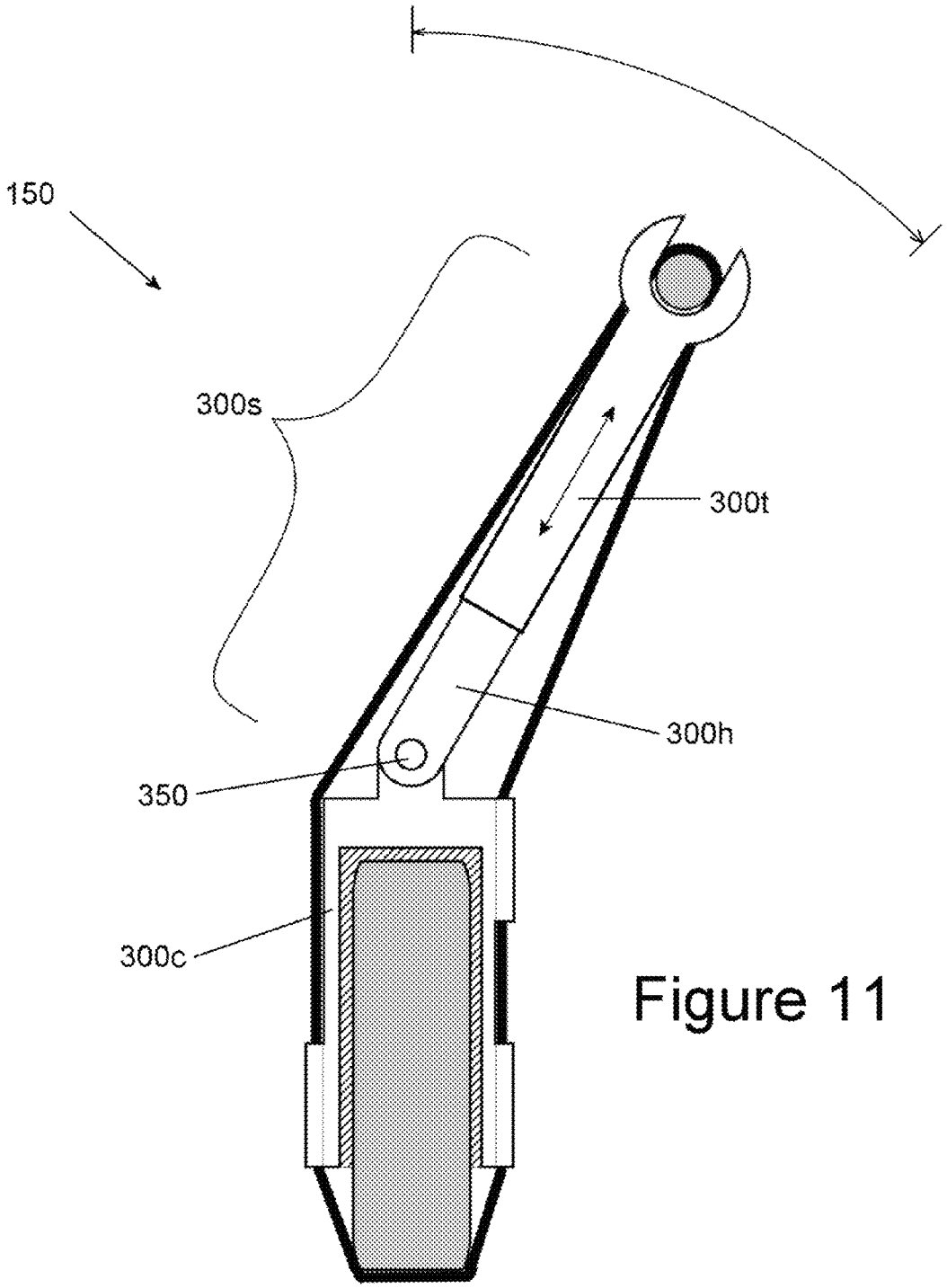
FIG. 11 is a side view of an advanced spacer having rotational and extensional capabilities.

Referring to FIG. 11, there is shown an elaborated version of the fore-portion attachment assembly 150 wherein the spacing member 300*s* further comprises a hinging-member 300*h* that rotatably attaches to the clip-member by way of a hinge 350 or other pivoting or jointing assembly. The hinge may be locked into a desired place or allowed to freely rotate during the playing of the instrument. Another option is a telescoping member 300*t* that slideably fits to the hinging-member 300*h*. In combination, the rotational and extensional capabilities thus obtained serve to provide a proper fit to any torque suppressor contour κ.

Figure 12:
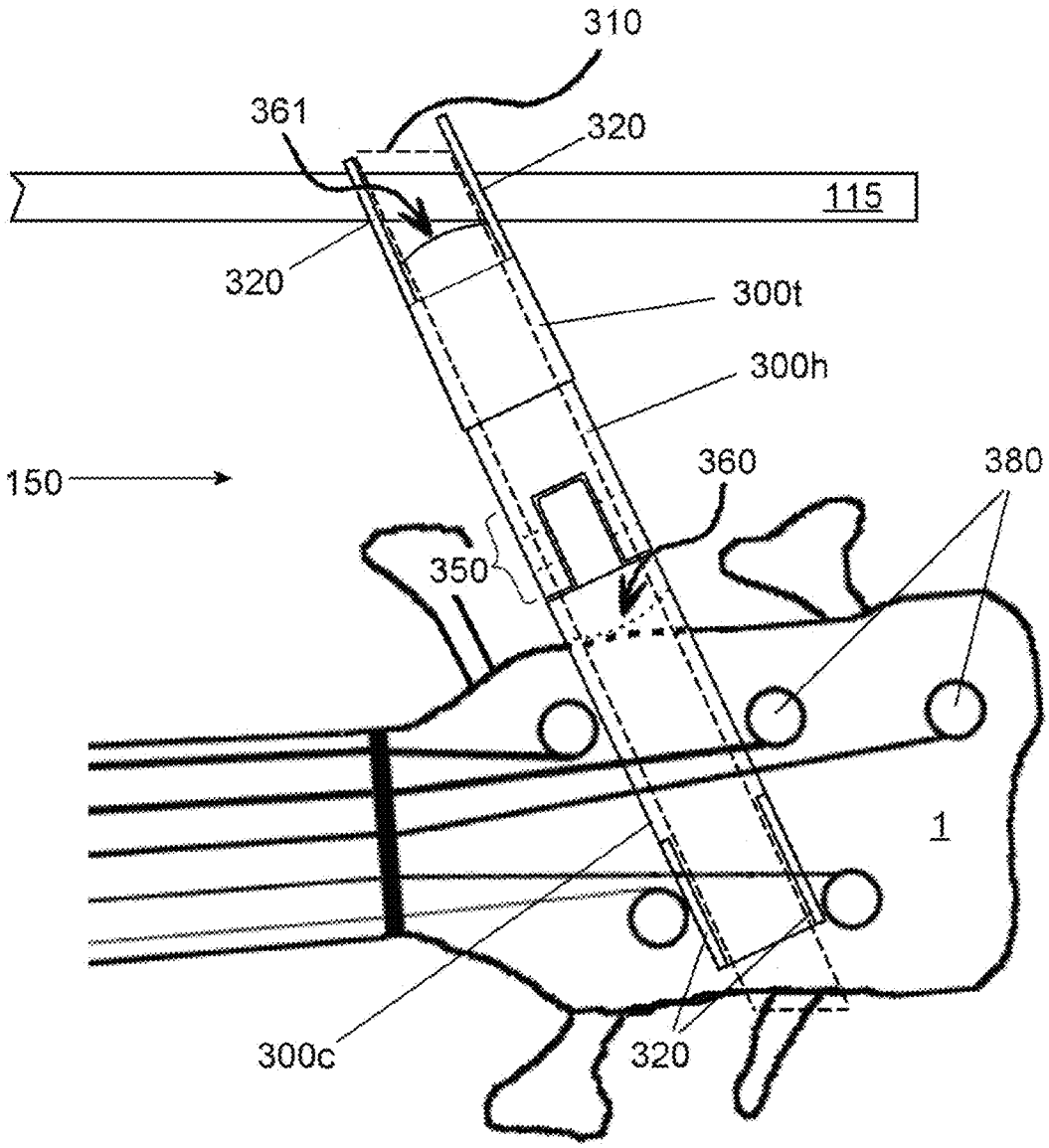
FIG. 12 is a perspective front view of the spacer of FIG. 11.

FIG. 12 is a side perspective of the embodiment of FIG. 11 in which it is shown how the fore-portion attachment assembly 150 may navigate amongst tuning machines 380 of the headstock 1. Here, lower and upper rocking surfaces 360, 361 are provided to allow good surface contact of the telescoping member 300*t* with the rod 115 and the clip member 300*c* with the headstock 1, respectively. This allows the clip member to be tilted at a wide range of angles so as to fit between the tuning machines 380 and secured with the spacer strap 310 (shown in dashed outline).

The foregoing disclosures relate to preferred embodiments of the invention and modifications may be made without departing from the spirit and scope of the invention as set forth in, and limited only by, the claims herein. Further, "instruments" need not be construed to be limited to musical instruments, but generally to any main assembly or body (e.g., a jackhammer) in attachment to a forward assembly that would be ported by way of a shoulder strap.

In the claims herein—unless explicitly indicated otherwise—the use of the word "or" is to be construed as the inclusive "or" in accordance with common usage in the engineering and computer arts.

What is claimed is:

1. A torque suppressor, comprising:

an extension attachable to a body and projecting therefrom in the general direction of, and substantially parallel to, a forward assembly disposed upon the body;

means for attachment of first end of a shoulder strap to said extension at an adjusted point of attachment;

means for attachment of a second end of said shoulder strap to the body at a rear point of attachment; and wherein the distance between said adjusted point of attachment and rear point of attachment is effective in substantially reducing neck dive torque attributable to a center of gravity of the instrument.

2. A torque suppressor for a body having a forward assembly comprising:

an extension comprising:

a rear-portion;

a mid-portion, and a fore-portion;

wherein said fore-portion is configured to attach to the forward assembly;

wherein said rear-portion is configured to attach to the body at a forward point of attachment; and wherein said mid-portion is configured to receive and attach to a first end of a shoulder strap, having a second end configured to attach to a rear point of attachment of the body.

3. The torque suppressor of claim 2 further comprising:

a body attachment device configured to operatively engage said rear-portion to a forward quadrant of the body.

4. The torque suppressor of claim 3 wherein said operative configuration of said body attachment device is a jointed configuration.

5. The torque suppressor of claim 4 wherein said jointed configuration is a universal joint.

6. The torque suppressor of claim 4 wherein said jointed configuration comprises a length of flexible material.

7. The torque suppressor of claim 1 wherein said rear-portion is generally parallel to said fore-portion.

8. The torque suppressor of claim 1 further comprising:

a transition-portion connecting said rear-portion with said mid-portion; and an overall configuration defining a contour κ expressible by an equation:

$$\kappa=|t|:d_0,d_1,d_2$$

where:

|t| is a lateral offset from the transition effected by said transition-portion from said forward point of attachment to said mid-portion;

$d_0$ is a distance from said forward point of attachment to said transition-portion;

$d_1$ is a distance from said forward point of attachment to said mid-portion; and $d_2$ is the total length of the torque-suppressor from the forward point of attachment to a distal end of said fore-portion.

9. The torque suppressor of claim 8 wherein |t| is from 0 to 2 inches.

10. The torque suppressor of claim 8 wherein $d_0$ is from 0 to 6 inches.

11. The torque suppressor of claim 8 wherein $d_1$ is from 0 to 12 inches.

12. The torque suppressor of claim 1 further comprising a shuttle moveably disposed upon said mid-portion and defining said adjusted point of attachment.

13. The torque suppressor of claim 1 further comprising a fore-portion attachment assembly configured to operatively attach said fore-portion to the forward assembly.

14. The torque suppressor of claim 13 wherein said fore-portion attachment assembly comprises a strap.

15. The torque suppressor of claim 13 wherein said fore-portion assembly comprises a spacer.

16. The torque suppressor of claim 13 wherein said fore-portion attachment assembly is operatively configured to hingedly attach to the forward assembly.

17. The torque suppressor of claim 13 wherein said fore-portion attachment assembly is operatively configured to telescopically attach to the forward assembly.

18. The torque suppressor of claim 1 wherein at least one of the body and forward assembly comprises a musical instrument.

19. A torque suppressor for a body having a forward assembly comprising:

an extension comprising:

a rear-portion;

a mid-portion, and a fore-portion;

wherein said fore-portion is configured to attach to the forward assembly;

wherein said rear-portion is configured to attach to the body at a forward point of attachment;

wherein said mid-portion is configured to receive and attach to a first end of a shoulder strap having a second end configured to attach to a rear point of attachment of the body; and wherein said first end and second end of an installed shoulder strap define a center of support positioned substantially directly above a center of gravity defined by said body and forward assembly.

20. The torque suppressor of claim 19 wherein said mid-portion is configured to adjustably attach to said first end of an installed shoulder strap so as to enable the user to change the distance between said second end of said installed shoulder strap and said center of gravity.

* * * * *